US007617575B2

(12) United States Patent
Sugihara et al.

(10) Patent No.: US 7,617,575 B2
(45) Date of Patent: Nov. 17, 2009

(54) WATER MIGRATION RESISTANT SNAP FASTENERS

(75) Inventors: Koki Sugihara, Saitama (JP); Katsushi Kitano, Lexington, KY (US)

(73) Assignee: YKK Corporation, Tokyo (JP)

( * ) Notice: Subject to any disclaimer, the term of this patent is extended or adjusted under 35 U.S.C. 154(b) by 21 days.

(21) Appl. No.: 11/973,635

(22) Filed: Oct. 9, 2007

(65) Prior Publication Data

US 2009/0089978 A1 Apr. 9, 2009

(51) Int. Cl.
*A44B 17/00* (2006.01)

(52) U.S. Cl. ..... 24/691

(58) Field of Classification Search ..... 24/107, 24/108, 662, 688, 689, 691, 696, 690, 692, 24/620, 621, 622, 682.1, 114.4, 94, 95
See application file for complete search history.

(56) References Cited

U.S. PATENT DOCUMENTS 1,646,053 A * 10/1927 Clark ..... 24/95
2,012,241 A * 8/1935 Dill ..... 24/682.1
2,548,004 A * 4/1951 Duefrene ..... 24/662
6,006,406 A * 12/1999 Chung ..... 24/713.6

FOREIGN PATENT DOCUMENTS

| | | | |
|---|---|---|---|
| JP | U-55-72407 | | 5/1980 |
| JP | Y2-63-8246 | | 3/1988 |
| JP | 10108712 | A * | 4/1998 |
| JP | 11346809 | A * | 12/1999 |
| KR | Y1-20-0401536 | | 11/2005 |

* cited by examiner

*Primary Examiner*—James R Brittain
(74) *Attorney, Agent, or Firm*—Alston & Bird LLP

(57) ABSTRACT

Snap fasteners are attached to a fabric or substrate and resist water migration from one side of the fabric or substrate to an opposite side of the fabric or substrate. The water migration resistant snap fasteners resist water migration through the fabric to which the snap fastener is attached while maintaining secure attachment to the fabric. The water migration resistant snap fasteners have radially offset patterned circles of gripping protrusions which do not penetrate through the fabric. Also, the radial patterned circles of gripping protrusions securely grip the fabric and maintain the snap fasteners in the proper location on the fabric.

17 Claims, 4 Drawing Sheets

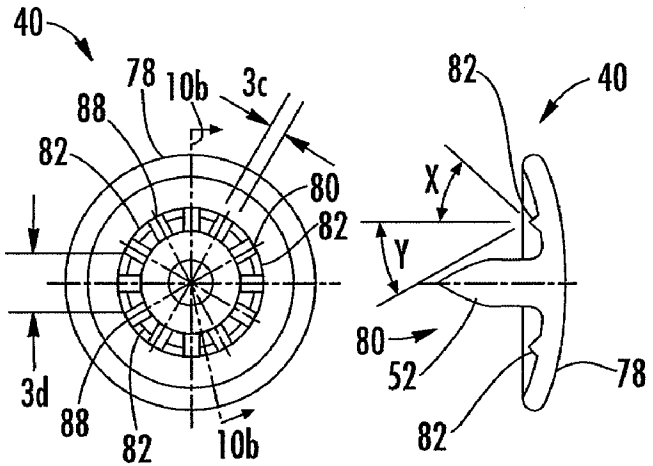
FIG. 10B
FIG. 10A
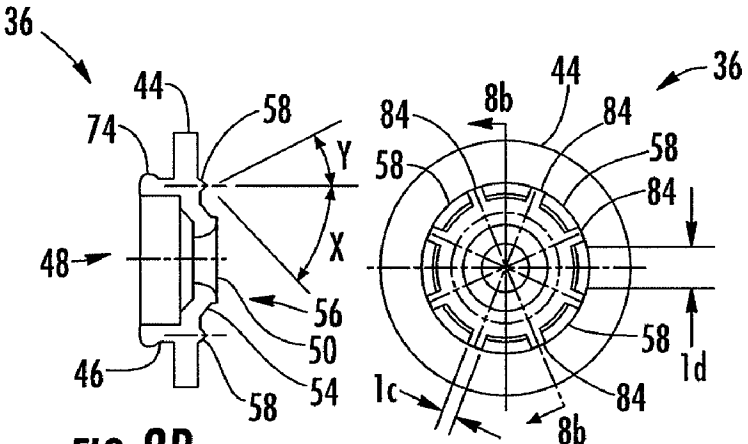
FIG. 8A
FIG. 8B
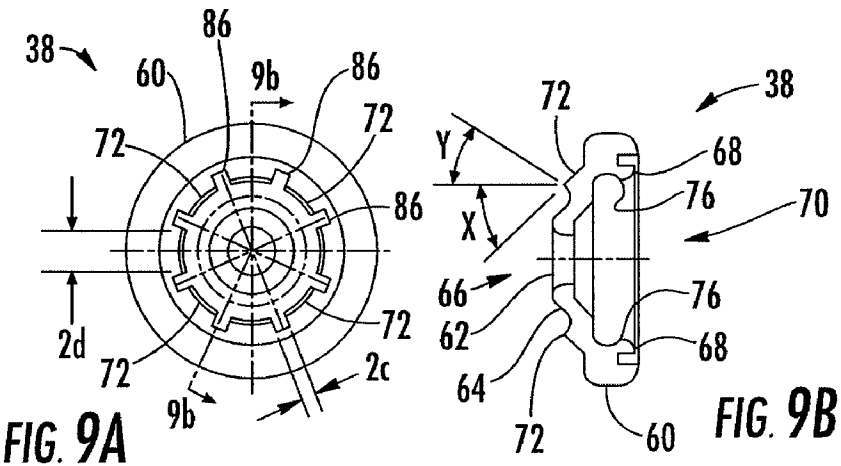
FIG. 9B
FIG. 9A

WATER MIGRATION RESISTANT SNAP FASTENERS

BACKGROUND OF THE INVENTION

The present invention generally pertains to snap fasteners. More specifically, the present invention pertains to water migration resistant snap fasteners. In embodiments, a snap fastener has radial patterned circles of gripping protrusions which securely grip a fabric or substrate and resist water migration from one side of the fabric or substrate to an opposite side of the fabric or substrate in the area of the snap fastener. Embodiments of the present invention can be particularly useful when used with waterproof or water resistant fabrics or substrates. The snap fasteners can provide effective resistance to water migration while maintaining effective holding strength of the snap fasteners to the waterproof fabric or substrate. The present invention also pertains to related methods, such as methods of making and using water migration resistant snap fasteners.

Water or liquid migration resistance is desirable for snap fasteners used in outdoor applications, for example, military applications, and other applications in which the snap fasteners come into contact with water, moisture or other liquids. Water migration refers to water, moisture or other liquids passing from one side of a fabric to which the snap fastener is attached to the opposite side of the fabric.

Snap fasteners which resist water migration exist. However, existing snap fasteners which resist water migration can be improved. FIGS. 1-5 show and an existing snap fastener 10 which can resist water migration. Referring to FIG. 1, the existing snap fastener attachment 10 has a cap or snaptop 12, a female member or socket 14, a male member or stud 16 and another cap or snaptop 12. The snap fastener attachment 10, as with various ordinary snap fastener products, requires a spring action function for engagement. The spring action can be provided, for example, by a spring action engagement portion 18 on the stud 16 and/or a spring action engagement portion 20 on the socket 14. The spring action engagement portion can be incorporated into either the socket 14 or the stud 16 (together called mating members) or both. Referring to FIGS. 2-5, when the snaptop 12 engages with the socket 14, the fabric 22 is positioned between the snaptop 12 and the socket 14. Similarly, when the snaptop 12 engages with the stud 16, the fabric 22 is positioned between the snaptop 12 and the stud 16.

Referring to FIG. 2, a pre-attaching position of the stud 16, the snaptop 12 and the fabric 22 is shown. The pre-attaching position of the socket 14 is the same as the pre-attaching position of the stud 16 shown in FIG. 2. FIG. 3 shows a post 24 of the snaptop 12 penetrating through the fabric 22 and engaging the stud 16. FIG. 4 shows the snaptop 12 and the stud 16 clamped by an upper attaching die 26 and a lower attaching die 28. The post 24 is deformed by the upper and lower attaching dies 26, 28 to attach the snaptop 12 and the stud 16 to the fabric 22. The snaptop 12 and the socket 14 are attached to the fabric 22 similarly as the snaptop 12 and the stud 16. FIG. 5 shows an alignment position for engagement of the stud 16 and the socket 14 (mating members) after the stud 16 and socket 14 have been attached to the fabric 22.

The snap fastener attachment 10 of FIGS. 1-5 can provide some resistance to water migration when attached to the waterproof fabric 22 by squeezing the fabric 22 between opposed flat surfaces of the stud 16 and the snaptop 12 or the socket 14 and the snaptop 12. However, the flat opposed surfaces provides weak fabric holding or gripping power. Snap fasteners attached to waterproof fabric can also have plastic or rubber washers placed against the fabric side surfaces to enhance resistance to water migration. However, washers are additional components and require additional manufacturing steps and increase costs.

It is desirable for snap fasteners attached to the fabric to stay in the attached position without rotation or sideways movement. This requirement applies generally to snap fasteners, including the snap fasteners of FIGS. 1-5, plastic snap fasteners, metal snap fasteners, metal and plastic combined snap fasteners, and other types of snap products as well.

Ordinary snap fasteners, such as the snap fastener attachment 10 of FIGS. 1-5, tend to rotate relative to the fabric 22 or slide (move sideways) relative to the fabric 22. The snaptop 12 and the socket 14 attached to the fabric 22 and the snaptop 12 and the stud 16 attached to the fabric 22 tend to rotate and/or move sideways relative to the fabric 22 due to spring back, snap fastener geometric tolerances, and inconsistent snap fastener attaching strength. These movements tend to cause enlargement of the holes in the fabric 22 created when the posts 24 of the snaptops 12, 12 penetrate the fabric 22. Enlargement of the holes is undesirable and may result in the snap fastener attachment 10 coming off of the fabric 22. Also, enlargement of the holes can allow water and other liquids to easily migrate from one side of the fabric 22 to the opposite side.

Referring to FIGS. 6 and 7, attempts to address the problems of rotating and sliding of existing snap fasteners include placing several gripping pins 30 on one or more of the snap fastener surfaces which penetrate the fabric 22 to increase the gripping strength of the snap fastener. FIG. 7 shows a snap fastener stud 32 with the gripping pins 30 engaged and attached to the fabric 22. The gripping pins 30 can improve gripping of the fabric 22, such as for specific fabrics like silk, cotton, and knit. However when snap fasteners having gripping pins 30 are attached to waterproof fabrics 22, the gripping pins 30 damage the fabric 22 because the gripping pins 30 tend to penetrate into or even through the fabric 22. Water, moisture and other liquids can migrate through the areas of the fabric 22 penetrated by the gripping pins 30 which is contrary to the purpose of the waterproof fabric 22. Gripping pins 30 can increase the holding strength, but the gripping pins 30 diminish resistance to water migration. To counteract the holes created by the gripping pins 30 penetrating the waterproof fabric 22, plastic or rubber washers can be placed onto the post 24 of the snaptop 34 to resist water migration. However, washers may not be desirable as mentioned above. As can been seen in FIG. 7, the gripping pins 30 of the stud 32 and the gripping pins 30 of the snaptop 34 are positioned at the same radial distance from a centerline. Also, the gripping pins have a pin-like shape.

Accordingly, existing snap fasteners, particularly snap fasteners intended to resist water migration, have experienced problems and can be improved. Thus, needs exist to improve snap fasteners for the reasons mentioned above and for other reasons.

SUMMARY OF THE INVENTION

The present invention provides new snap fasteners which resist water migration from one side of a fabric or substrate to which the snap fastener is attached to the opposite side of the fabric or substrate. Embodiments of water migration resistant snap fasteners of the present invention have radially offset patterned circles of gripping protrusions which do not penetrate through the fabric. Also, the radially offset patterned circles of gripping protrusions securely grip the fabric and maintain the snap fasteners in the proper location on the fabric.

The water migration resistant snap fasteners of the present invention can be particularly useful in applications where the snap fasteners come into contact with water, moisture or other liquids. The water migration resistant snap fasteners can be used in military applications, outdoor applications, and other applications where water, moisture or liquid migration resistance is desired. The water migration resistant snap fasteners may be made of plastic materials which resist water, moisture or other liquids. Of course, the water migration resistant snap fasteners can be made of other materials, such as metal materials.

In an embodiment of the present invention, a water migration resistant device is attachable to a fabric and releasably engagable with a mating snap fastener member. The water migration resistant device has a first member having an engagement portion on a first side and being releasably engagable with the mating snap fastener member. The first member has a fabric contact side opposite the first side. A plurality of first fabric gripping protrusions are provided on the fabric contact side of the first member. The first fabric gripping protrusions are non-fabric-penetrating protrusions. A second member is lockingly engagable to the first member and has a fabric contact side. A plurality of second fabric gripping protrusions are provided on the fabric contact side of the second member. The second fabric gripping protrusions are non-fabric-penetrating protrusions. The plurality of first and second fabric gripping protrusions are offset from each other such that during use of the water migration resistant device the first and second members are lockingly engaged with each other with the fabric captured between the first and second members without the first and second fabric gripping protrusions penetrating the fabric.

The plurality of first fabric gripping protrusions may be arranged in a circular pattern about a center of the water migration resistant device. The plurality of second fabric gripping protrusions may be arranged in a circular pattern about the center of the water migration resistant device and radially offset from the plurality of first fabric gripping protrusions.

The plurality of first fabric gripping protrusions may be arranged at a radial distance from the center which is greater than a radial distance from the center for the plurality of second fabric gripping protrusions.

Adjacent individual first fabric gripping protrusions of the plurality of first fabric gripping protrusions may be circumferentially spaced apart from each other by a gap, and the individual first fabric gripping protrusion may have a length which is longer than a length of the gap.

Adjacent individual second fabric gripping protrusions of the plurality of second fabric gripping protrusions may be circumferentially spaced apart from each other by a gap, and the individual second fabric gripping protrusion may have a length which is longer than a length of the gap.

The first member may be a snap fastener stud or a snap fastener socket. The second member may be a snaptop.

The first and second members may be made of plastic.

At least one of the plurality of first and second fabric gripping protrusions may have a triangular shape in cross-section in which a first side of the triangular shape is a base side of the triangular shape on the respective first member or second member, an apex of the triangular shape is opposite the first side, a second side of the triangular shape forms an angle Y at the apex which is about 45° or less, and a third side of the triangular shape forms an angle X at the apex of about 45°. The second side of the triangular shape having the angle Y of the first fabric gripping protrusion may face the second side of the triangular shape having the angle Y of the second fabric gripping protrusion.

In another embodiment of the present invention, a water migration resistant device is attachable to a fabric and releasably engagable with a mating snap fastener member. The water migration resistant device has a water migration resistant snap fastener member having a body portion having an engagement portion on a first side of the body portion releasably engagable with the mating snap fastener member and a fabric contact side opposite the first side. A plurality of first fabric gripping protrusions are provided on the fabric contact side of the body portion of the snap fastener member. The first fabric gripping protrusions are non-fabric-penetrating protrusions. A water migration resistant snaptop is lockingly engagable to the water migration resistant snap fastener member and has a body portion having a fabric contact side. A plurality of second fabric gripping protrusions are provided on the fabric contact side of the body portion of the snaptop. The second fabric gripping protrusions are non-fabric-penetrating protrusions. The plurality of first and second fabric gripping protrusions are offset from each other such that during use of the water migration resistant device the water migration resistant snap fastener member and the water migration resistant snaptop are lockingly engaged with each other with the fabric captured between the water migration resistant snap fastener member and the water migration resistant snaptop without the first and second fabric gripping protrusions penetrating the fabric.

The plurality of first fabric gripping protrusions may be arranged in a circular pattern about a center of the water migration resistant device. The plurality of second fabric gripping protrusions may be arranged in a circular pattern about the center of the water migration resistant device and are radially offset from the plurality of first fabric gripping protrusions.

The plurality of first fabric gripping protrusions may be arranged at a radial distance from the center which is greater than a radial distance from the center for the plurality of second fabric gripping protrusions.

Adjacent individual first fabric gripping protrusions of the plurality of first fabric gripping protrusions may be circumferentially spaced apart from each other by a first gap. The individual first fabric gripping protrusion may have a length which is longer than a length of the first gap. Adjacent individual second fabric gripping protrusions of the plurality of second fabric gripping protrusions may be circumferentially spaced apart from each other by a second gap. The individual second fabric gripping protrusion may have a length which is longer than a length of the second gap.

The plurality of first and second fabric gripping protrusions may have a triangular shape in cross-section in which a first side of the triangular shape is a base side of the triangular shape on the body portion of the respective snap fastener member or snaptop, an apex of the triangular shape is opposite the first side, a second side of the triangular shape forms an angle Y at the apex which is about 45° or less, and a third side of the triangular shape forms an angle X at the apex of about 45°. The second side of the triangular shape having the angle Y of the first fabric gripping protrusion faces the second side of the triangular shape having the angle Y of the second fabric gripping protrusion.

In another embodiment of the present invention, a water migration resistant snap fastener is attachable to a fabric and has a stud having a socket engagement portion on a first side and a fabric contact side opposite the first side. A plurality of first fabric gripping protrusions are provided on the fabric contact side of the stud and are arranged in a generally circular pattern. The first fabric gripping protrusions are non-fabric-penetrating protrusions. A first snaptop is lockingly engagable to the stud with the fabric therebetween during use. The first snaptop has a fabric contact side. A plurality of second fabric gripping protrusions are provided on the fabric contact side of the first snaptop and are arranged in a generally circular pattern. The second fabric gripping protrusions are radially offset from the first fabric gripping protrusions and are non-fabric-penetrating protrusions. A socket has a stud engagement portion on a first side and a fabric contact side opposite the first side. The stud and the socket are releasably engagable with each other. A plurality of third fabric gripping protrusions are provided on the fabric contact side of the socket and are arranged in a generally circular pattern. The third fabric gripping protrusions are non-fabric-penetrating protrusions. A second snaptop is lockingly engagable to the socket with the fabric therebetween during use. The second snaptop has a fabric contact side. A plurality of fourth fabric gripping protrusions are provided on the fabric contact side of the second snaptop and are arranged in a generally circular pattern. The fourth fabric gripping protrusions are radially offset from the third fabric gripping protrusions and are non-fabric-penetrating protrusions.

Embodiments of the present invention may have various features and provide various advantages. Any of the features and advantages of the present invention may be desired, but, are not necessarily required to practice the present invention.

Advantages of the present invention can be to provide new snap fasteners.

Further advantages of the present invention can be to provide water migration resistant snap fasteners.

Another advantage of the present invention can be to resist or even prevent water, moisture or other liquids from migrating from one side of a fabric to an opposite side of the fabric in the area that the snap fastener is attached to the fabric.

A further advantage of the present invention can be to provide a waterproof seal between a snap fastener, such as a plastic snap fastener, and a fabric.

Other advantages may include providing new methods of making and using water migration resistant snap fasteners.

Additional features and advantages of the present invention are described in, and will be apparent from, the following Detailed Description of the Invention and the figures.

BRIEF DESCRIPTION OF THE FIGURES

FIG. 8*a* is a plan view of a stud of a water migration resistant snap fastener according to the present invention and FIG. 8*b* is a cross-sectional view of the stud along the line 8*b*-8*b* of FIG. 8*a*.

FIG. 9*a* is a plan view of a socket of the water migration resistant snap fastener according to the present invention and FIG. 9*b* is a cross-sectional view of the socket along the line 9*b*-9*b* of FIG. 9*a*.

FIG. 10*a* is a plan view of a snaptop of the water migration resistant snap fastener according to the present invention and FIG. 10*b* is a cross-sectional view of the snaptop along the line 10*b*-10*b* of FIG. 10*a*.

DETAILED DESCRIPTION OF THE INVENTION

One example of a water migration resistant snap fastener according to the present invention is shown in FIGS. 8-12. The water migration resistant snap fastener has a stud 36 (FIGS. 8*a* and 8*b*), a socket 38 (FIGS. 9*a* and 9*b*) and a pair of snaptops 40 (FIGS. 10*a* and 10*b*), one snaptop 40 for each of the stud 36 and the socket 38. The water migration resistant snap fastener resists or even prevents water migration from one side of the fabric to which the water migration resistant snap fastener is attached to the opposite side of the fabric. The water migration resistant snap fastener also maintains secure holding strength to the fabric. Although the term "fabric" is frequently used in this disclosure, the term "fabric" is used generally and can include other substrates, sheets and sheet-like materials. Water migration resistant snap fasteners according to the present invention are preferably used with waterproof fabrics or water resistant fabrics.

Figure 1:
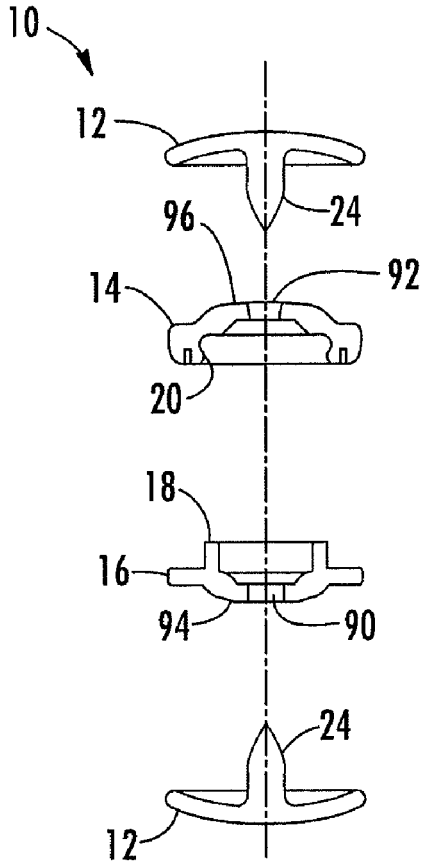
FIG. 1 (PRIOR ART)
FIG. 1 is an exploded, partial cross-sectional view of an existing snap fastener.
Figure 2:
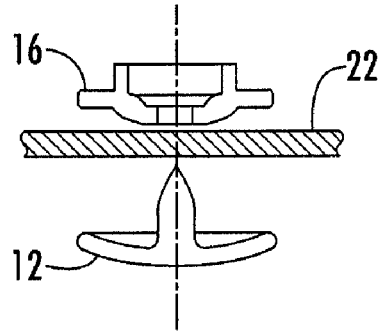
FIG. 2 (PRIOR ART)
FIG. 2 is a partial cross-sectional view of a snaptop and a stud of the existing snap fastener of FIG. 1 positioned for attachment to a fabric.
Figure 3:
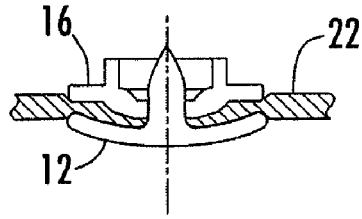
FIG. 3 (PRIOR ART)
FIG. 3 is a partial cross-sectional view of the snaptop and the stud of the existing snap fastener during attachment to the fabric.
Figure 4:
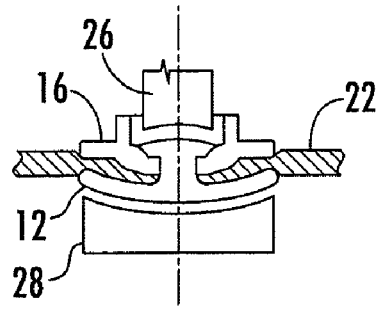
FIG. 4 (PRIOR ART)
FIG. 4 is another partial cross-sectional view of the snaptop and the stud of the existing snap fastener during attachment to the fabric.
Figure 5:
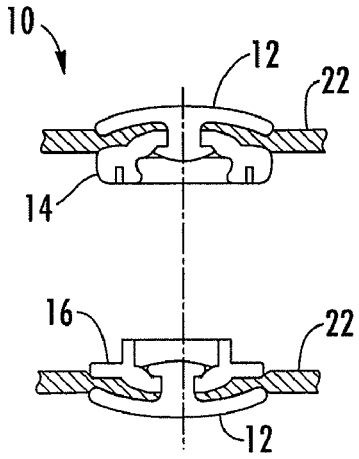
FIG. 5 (PRIOR ART)
FIG. 5 is a partial cross-sectional view of the existing snap fastener of FIG. 1 attached to the fabric.
Figure 6:
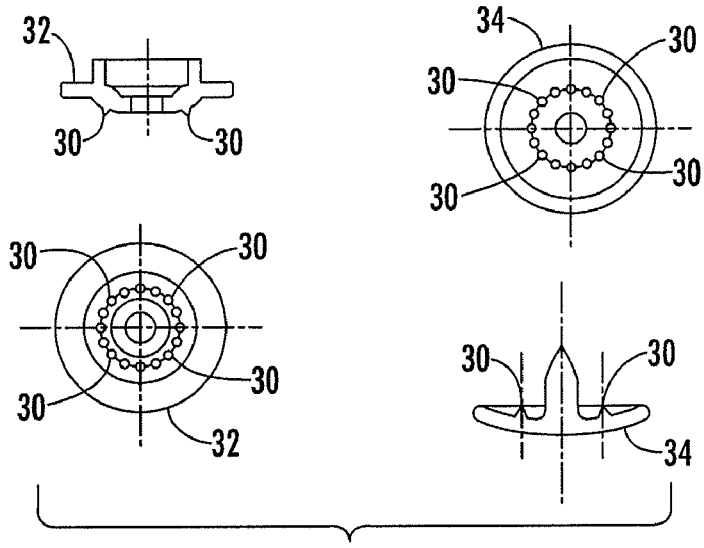
FIG. 6 (PRIOR ART)
FIG. 6 shows a snaptop and a stud of another existing snap fastener in which the snaptop and the stud have gripping pins.
Figure 7:
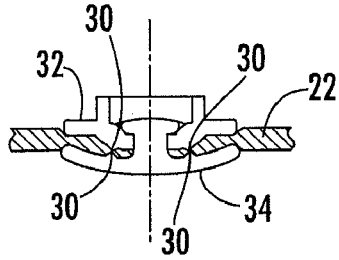
FIG. 7 (PRIOR ART)
FIG. 7 shows the existing snaptop and stud of FIG. 6 attached to a fabric.
Figure 12:
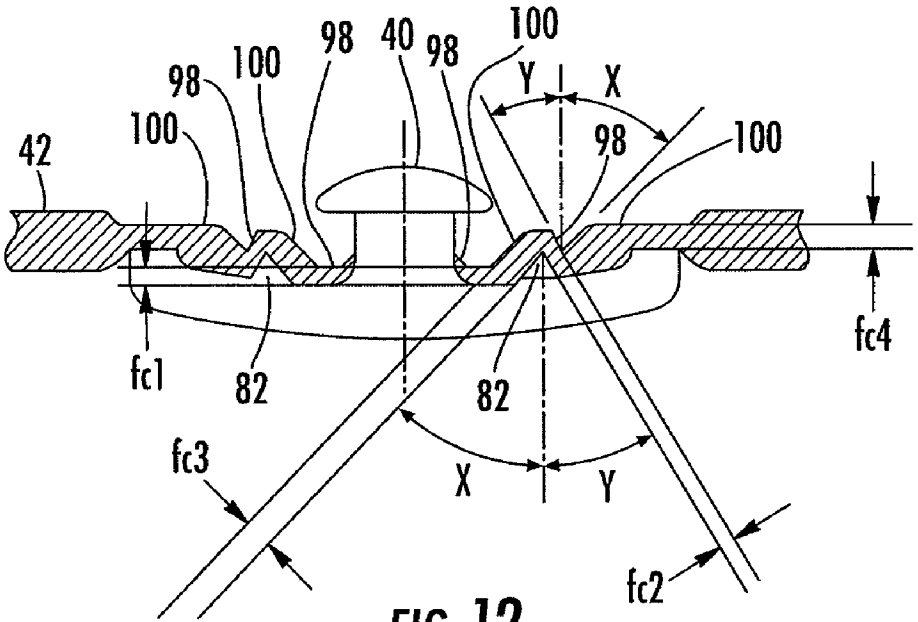
FIG. 12 is an enlarged view of FIG. 12 with the stud omitted and showing the snaptop engaged with the fabric.
Figure 11:
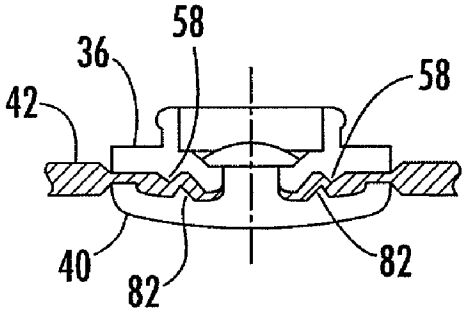
FIG. 11 is a cross-sectional view of the stud of FIGS. 8*a* and 8*b* and the snaptop of FIGS. 10*a* and 10*b* attached to a fabric or other substrate.

FIG. 8*a* is a plan view showing the stud 36 of the water migration resistant snap fastener and FIG. 8*b* is a cross-sectional view of the stud 36. FIG. 9*a* is a plan view showing the socket 38 of the water migration resistant snap fastener and FIG. 9*b* is a cross-sectional view of the socket 38. FIG. 10*a* is a plan view showing the snaptop 40 of the water migration resistant snap fastener and FIG. 10*b* is a cross-sectional view of the snaptop 40. FIG. 11 is a cross-sectional view showing the stud 36 and the snaptop 40 attached to a fabric or other substrate 42. FIG. 12 is an enlarged view of FIG. 11 with the stud 36 omitted and showing the snaptop 40 engaged with the fabric 42.

Referring to FIGS. 8*a* and 8*b*, the stud 36 of the water migration resistant snap fastener has an annular flange body portion 44. A generally cylindrical shaped spring action engagement portion 46 extends in an axial direction from the annular flange body portion 44 on a socket engagement side 48 of the annular flange body portion 44. The annular flange body portion 44 has a central hole 50 for receiving a post 52 of the snaptop 40 (FIGS. 10*a* and 10*b*). The annular flange body portion 44 has a rim 54 offset in the axial direction around the hole 50 toward a fabric side 56 of the annular flange body portion 44. The stud 36 has gripping protrusions 58 on the fabric side 56 which are described in detail below.

Referring to FIGS. 9*a* and 9*b*, the socket 38 of the water migration resistant snap fastener has an annular body portion 60 having a central hole 62 for receiving the post 52 of the snaptop 40 (FIGS. 10*a* and 10*b*). The annular body portion 60 has a rim 64 offset in an axial direction around the hole 62 toward a fabric side 66 of the annular body portion 60. The annular body portion 60 has a generally cylindrical shaped spring action engagement portion 68 in the axial direction on a stud engagement side 70 of the annular body portion 60. The socket 38 has gripping protrusions 72 on the fabric side 66 which are described in detail below.

The stud 36 and the socket 38 of the water migration resistant snap fastener can be removably snapped together. More specifically, the spring action engagement portions 46, 68 of the stud 36 and the socket 38 can be resiliently engaged and disengaged with each other. The spring action engagement portion 46 of the stud 36 has an outer diameter along with and inner diameter of the spring action engagement portion 68 of the socket 38 which allows for a resilient spring action interference fit. An outward facing annular protrusion 74 on the spring action engagement portion 46 of the stud 36 resiliently slides past a corresponding inward facing annular protrusion 76 on the spring action engagement portion 68 of the socket 38 during engagement and disengagement of the stud 36 and the socket 38.

Referring to FIGS. 10*a* and 10*b*, the snaptop 40 has an annular flange body portion 78 having a fabric side 80. The post 52 extends in an axial direction from the fabric side 80 of the annular flange body portion 78. The snaptop 40 also has gripping protrusions 82 on the fabric side 80 which are described in detail below. The snaptop 40 is a post-attached type member. However, the present invention can be practiced using any other suitable snaptops.

The gripping protrusions 58, 72, 82, which are a significant feature of the present invention, will now be described in detail with reference to FIGS. 8-12. The gripping protrusions 58, 72, 82 are radial patterned circles of gripping protrusions placed on the fabric sides 56, 66, 80 of the stud 36 (FIGS. 8*a* and 8*b*), the socket 38 (FIGS. 9*a* and 9*b*) and the snaptop 40 (FIGS. 10*a* and 10*b*). The radial patterned circles of gripping protrusions 58, 72, 82 are located in a particular pattern to increase gripping strength of the fabric 42, prevent the attached water migration resistant snap fasteners from rotating or sliding on the fabric 42 and create watertight seals against the fabric 42. Geometrically, the radial patterned gripping protrusions 58 of the stud 36 and the radial patterned gripping protrusions 72 of the socket 38 are identical. However, the radial patterned gripping protrusions 58, 72 of the stud 36 and the socket 38 are offset radially from the radial patterned gripping protrusions 82 of the snaptop 40. The radially offset structure or arrangement of the gripping protrusions allow the cooperating gripping protrusions to interact with each other to securely grip the fabric 42 and form a watertight seal. The gripping protrusions 58 of the stud 36 cooperate with the gripping protrusions 82 of one snaptop 40, and the gripping protrusions 72 of the socket 38 cooperate with the gripping protrusions 82 of the other snaptop 40 to securely grip the fabric 42 and form a watertight seal.

Referring to FIGS. 11 and 12, FIG. 11 shows the stud 36 engaged with the snaptop 40 and attached to the fabric 42. FIG. 12 shows an enlarged view of FIG. 11 with the stud 36 omitted to show an example of the gripping protrusions 82 of the snaptop 40 engaged with the fabric 42. The arrangement and the engagement of the stud 36, the snaptop 40 and the fabric 42 shown in FIGS. 11 and 12 is the same as the arrangement and engagement of the socket 38, the snaptop 40 and the fabric 42.

Referring to FIG. 12, the gripping protrusions 82 have a triangular shape in cross-section. A first side of the triangular shape is a base side of the triangular shape on the snaptop 40. An apex of the triangular shape is opposite the first side of the triangular shape. A second side of the triangular shape forms an angle Y at the apex, and a third side of the triangular shape forms an angle X at the apex. As can be seen in FIGS. 8-12, the second side of the triangular shape having the angle Y of the snaptop 40 faces the second side of the triangular shape having the angle Y of the stud 36 or socket 38. A preferred angel Y is 45° or less, and a preferred angle X is about 45°. The fabric 42 is squeezed without penetration by the gripping protrusions 82, 58 between radial clearances fc1, fc2, fc3, and fc4. Rotation and sliding of the water migration resistant snap fastener relative to the fabric 42 is effectively eliminated. The clearance of fc1 can be less than the clearance of fc2, fc3, and fc4.

The patterned circles of gripping protrusions 58, 72, 82 do not penetrate the fabric 42. Rather, the patterned circles of gripping protrusions 58, 72, 82 are structured so that the fabric 42 wraps around the patterned circles of gripping protrusions 58, 72, 82. One reason resistance to water migration through the fabric 42 is maintained is because the patterned circles of gripping protrusions 58, 72, 82 do not penetrate the fabric 42.

Referring to FIGS. 8-10, the patterned circles of gripping protrusions 58, 72, 82 do not extend continuously around a circle. Rather, there are gaps 84 (FIGS. 8*a*, 8*b*), gaps 86 (FIGS. 9*a*, 9*b*) and gaps 88 (FIGS. 10*a*, 10*b*) between respective individual gripping protrusions 58, 72, 82. In other words, adjacent individual gripping protrusions are circumferentially spaced apart from each other by the gap. As shown in FIG. 8*a*, each individual gripping protrusion 58 of the stud 36 has a length 1*d* which is longer than a length 1*c* of the gap 84. As shown in FIG. 9*a*, each individual gripping protrusion 72 of the socket 38 has a length 2*d* which is longer than a length 2*c* of the gap 86. As shown in FIG. 10*a*, each individual gripping protrusion 82 of the snaptop 40 has a length 3*d* which is longer than a length 3*c* of the gap 88. The lengths 1*d*, 2*d*, 3*d* of the individual gripping protrusions 58, 72, 82 should be greater than the lengths 1*c*, 2*c*, 3*c* of the gaps 84, 86, 88, respectively.

One advantage of the gripping protrusions 58, 72, 82 is the water migration resistant snap fastener has a watertight seal against the fabric 42. Referring to the existing snap fastener 10 of FIGS. 1-5, the stud 16 has a hole 90 for the post 24 of the snaptop 12 and the socket 14 has a hole 92 for the post 24 of the snaptop 12. The stud 16 and the socket 14 each have a raised rim 64, 96 around their respective post holes 90, 92. When the stud 16 or socket 14 is engaged with its snaptop 12, the spaces between the posts 24, 24 of the snaptop 12 and the rim 94, 96 around the holes 90, 92 of the stud 16 and the socket 14 is quite tight and normally the holes 90, 92 will become larger during attachment. The enlarged holes 90, 92 can cause leakage or water migration through the fabric 22. However, embodiments of the water migration resistant snap fasteners of the present invention do not have such a hole enlargement problem and the resulting water migration problem.

Referring to FIGS. 8-12, the radially offset patterned circles of gripping protrusions 58, 72, 82 change the forces of the assembled stud 36, fabric 42 and snaptop 40 and the assembled socket 38, fabric 42 and snaptop 40 that would otherwise tend to enlarge the holes 50, 62 in the stud 36 and the socket 38. The forces generated by the offset patterned circles of gripping protrusions 58, 72, 82 onto the raised rim 54 of the stud 36 or the raised rim 64 of the socket 38 do not change the geometry of the hole 50 in the stud 36 or the hole 62 in the socket 38, i.e. the holes 50, 62 do not enlarge. Accordingly, water migration due to enlarged holes 50, 62 in the stud 36 or the socket 38 does not occur. Also, when the stud 36 is engaged with the snaptop 40, the rim 54 around the hole 50 reaches the bottom of the snaptop post 52 (the portion of the post 52 connected to or adjacent to the annular flange body portion 78 of the snaptop 40) and the rim 54 provides a pressure force to the fabric 42 effecting a water migration seal completely around the post 52 of the snaptop 40 while the fabric 42 is securely gripped. The socket 38 and the snaptop 40 function similarly.

When the snaptop 40 is engaged with the stud 36 or the socket 38, the gripping protrusions 82 of the snaptop 40 are offset radially relative to the respective cooperating gripping protrusions 58 of the stud 36 or the gripping protrusions 72 of the socket 38. The number of gaps 88 and gripping protrusions 82 of the snaptop 40 can be different relative to the number of the gaps 84, 86 and the gripping protrusions 58, 72 of the stud 36 and the socket 38 to provide circumferential staggering of the offset patterned circles of gripping protrusions 58, 72, 82. The circumferential staggering of the offset patterned circles of gripping protrusions 58, 72, 82 can provide enhanced gripping of the fabric 42.

Referring to FIGS. 11 and 12, the offset patterned circles of gripping protrusions 58, 72, 82 cause an intricate pattern of alternately compressed fabric portions 98 (the fabric 42 is relatively thinner due to the compression) and uncompressed or less compressed fabric portions 100 (the fabric 42 is relatively thicker due to the lower amount of compression or lack of compression). The intricate pattern of alternately compressed and uncompressed fabric portions 98, 100 caused by the offset patterned circles of gripping protrusions 58, 72, 82 creates enhanced resistance to rotation and slippage of the water migration resistant snap fastener because of friction between the fabric 42 and the offset patterned circles of gripping protrusions 58, 72, 82.

Embodiments of the present invention can provide important advantages. For example, embodiments of the water migration resistant snap fastener can securely hold the fabric 42 by squeezing the fabric 42 without penetrating the fabric 42 and by using friction created by forming alternately thick and thin fabric portions to grip the fabric 42. Embodiments of the present invention applied to waterproof fabric 42 can provide watertight seals between the fabric 42 and the stud 36 and snaptop 40 and between the fabric 42 and the socket 38 and snaptop 40. A particularly watertight seal against water migration can be at the location fc1 shown in FIG. 12. Embodiments of the present invention can apply a fabric gripping force over a larger surface area than the surface area having a gripping force of prior snap fasteners. Furthermore, the stud 36 and the snaptop 40 engage tightly which provides a strong pressure force to reduce moisture migration. Similarly, the socket 38 and the snaptop 40 also engage tightly which provides a strong pressure force to reduce moisture migration. Also, embodiments of the present invention do not penetrate and damage the fabric 42. Therefore, the present invention provides improved resistance to water migration.

Another feature or advantage of embodiments of the present invention is that the stack height of the water migration resistant snap fastener has a low-profile. In other words, the overall height of the water migration resistant snap fastener is not excessively large as with some existing snap fasteners. The heights of the assembled stud 36 and snaptop 40 and the assembled socket 38 and snaptop 40 are low as well as the overall height of the snap fastener when the stud 36 and the socket 38 are snapped together. The low-profile of the water migration resistant snap fastener can be achieved while maintaining the secure attachment to the fabric 42 and maintaining the watertight seals against the fabric.

The present invention can be practiced with many changes made to the disclosed examples of the water migration resistant snap fastener. Also, any portion or portions of the water migration resistant snap fastener or the entire water migration resistant snap fastener socket can be made of any desired material or combination of materials. For example, the water migration resistant snap fastener may be made of plastic material. Of course, other materials can be used alone or in combination with plastic materials, for example metal materials.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A water migration resistant device attachable to a fabric and releasably engagable with a mating snap fastener member, the water migration resistant device comprising:

a first member having an engagement portion on a first side and being releasably engagable with the mating snap fastener member, the first member having a fabric contact side opposite the first side;

a plurality of first fabric gripping protrusions on the fabric contact side of the first member, the first fabric gripping protrusions being non-fabric-penetrating protrusions;

a second member lockingly engagable to the first member and having a fabric contact side; and a plurality of second fabric gripping protrusions on the fabric contact side of the second member, the second fabric gripping protrusions being non-fabric-penetrating protrusions;

wherein:

the plurality of first and second fabric gripping protrusions are offset from each other such that during use of the water migration resistant device, the first and second members are lockingly engaged with each other with the fabric captured between the first and second members without the first and second fabric gripping protrusions penetrating the fabric, the plurality of first fabric gripping protrusions are arranged in a first circular pattern about a center of the water migration resistant device, the plurality of second fabric gripping protrusions are arranged in a second circular pattern about the center of the water migration resistant device and are radially offset from the plurality of first fabric gripping protrusions, first portions of the fabric captured between the first and second members are squeezed by the gripping protrusions and are compressed relative to second portions of the fabric that are not squeezed by the gripping protrusions, and the first portions and the second portions of fabric are alternately spaced in a radial pattern and an axial pattern between the first member and the second member.

2. The water migration resistant device of claim 1, wherein the plurality of first fabric gripping protrusions are arranged at a radial distance from the center which is greater than a radial distance from the center for the plurality of second fabric gripping protrusions.

3. The water migration resistant device of claim 2, wherein adjacent individual first fabric gripping protrusions of the plurality of first fabric gripping protrusions are circumferentially spaced apart from each other by a first gap, and the individual first fabric gripping protrusion has a length which is longer than a length of the first gap, and wherein adjacent individual second fabric gripping protrusions of the plurality of second fabric gripping protrusions are circumferentially spaced apart from each other by a second gap, and the individual second fabric gripping protrusion has a length which is longer than a length of the second gap.

4. The water migration resistant device of claim 2, wherein the plurality of first and second fabric gripping protrusions has a triangular shape in cross-section, a first side of the triangular shape being a base side of the triangular shape on the respective first member or second member, an apex of the triangular shape being opposite the first side, a second side of the triangular shape forming an angle Y at the apex which is about 45° or less, and a third side of the triangular shape forming an angle X at the apex of about 45°; and wherein the second side of the triangular shape having the angle Y of the first fabric gripping protrusion faces the second side of the triangular shape having the angle Y of the second fabric gripping protrusion.

5. The water migration resistant device of claim 1, wherein adjacent individual first fabric gripping protrusions of the plurality of first fabric gripping protrusions are circumferentially spaced apart from each other by a gap, and the individual first fabric gripping protrusion has a length which is longer than a length of the gap.

6. The water migration resistant device of claim 1, wherein adjacent individual second fabric gripping protrusions of the plurality of second fabric gripping protrusions are circumferentially spaced apart from each other by a gap, and the individual second fabric gripping protrusion has a length which is longer than a length of the gap.

7. The water migration resistant device of claim 1, wherein the first member is a snap fastener stud.

8. The water migration resistant device of claim 7, wherein the second member is a snaptop.

9. The water migration resistant device of claim 1, wherein the first member is a snap fastener socket.

10. The water migration resistant device of claim 9, wherein the second member is a snaptop.

11. The water migration resistant device of claim 1, wherein the first and second members are made of plastic.

12. The water migration resistant device of claim 1, wherein at least one of the plurality of first and second fabric gripping protrusions has a triangular shape in cross-section, a first side of the triangular shape being a base side of the triangular shape on the respective first member or second member, an apex of the triangular shape being opposite the first side, a second side of the triangular shape forming an angle Y at the apex which is about 45° or less, and a third side of the triangular shape forming an angle X at the apex of about 45°.

13. A water migration resistant device attachable to a fabric and releasably engagable with a mating snap fastener member, the water migration resistant device comprising:

a water migration resistant snap fastener member having:

a body portion having an engagement portion on a first side of the body portion releasably engagable with the mating snap fastener member and a fabric contact side opposite the first side;

a plurality of first fabric gripping protrusions on the fabric contact side of the body portion of the snap fastener member, the first fabric gripping protrusions being non-fabric-penetrating protrusions; and a water migration resistant snaptop lockingly engagable to the water migration resistant snap fastener member and having:

a body portion having a fabric contact side;

a plurality of second fabric gripping protrusions on the fabric contact side of the body portion of the snaptop, the second fabric gripping protrusions being non-fabric-penetrating protrusions;

wherein:

the plurality of first and second fabric gripping protrusions are offset from each other such that during use of the water migration resistant device, the water migration resistant snap fastener member and the water migration resistant snaptop are lockingly engaged with each other with the fabric captured between the water migration resistant snap fastener member and the water migration resistant snaptop without the first and second fabric gripping protrusions penetrating the fabric, the plurality of first fabric gripping protrusions are arranged in a first circular pattern about a center of the water migration resistant device, the plurality of second fabric gripping protrusions are arranged in a second circular pattern about the center of the water migration resistant device and are radially offset from the plurality of first fabric gripping protrusions, first portions of the fabric captured between the water migration resistant snap fastener member and the water migration resistant snaptop are squeezed by the gripping protrusions and are compressed relative to second portions of the fabric that are not squeezed by the gripping protrusions, and the first portions and the second portions of fabric are alternately spaced in a radial pattern and an axial pattern between the water migration resistant snap fastener member and the water migration resistant snaptop.

14. The water migration resistant device of claim 13, wherein the plurality of first fabric gripping protrusions are arranged at a radial distance from the center which is greater than a radial distance from the center for the plurality of second fabric gripping protrusions.

15. The water migration resistant device of claim 14, wherein adjacent individual first fabric gripping protrusions of the plurality of first fabric gripping protrusions are circumferentially spaced apart from each other by a first gap, and the individual first fabric gripping protrusion has a length which is longer than a length of the first gap, and wherein adjacent individual second fabric gripping protrusions of the plurality of second fabric gripping protrusions are circumferentially spaced apart from each other by a second gap, and the individual second fabric gripping protrusion has a length which is longer than a length of the second gap.

16. The water migration resistant device of claim 14, wherein the plurality of first and second fabric gripping protrusions has a triangular shape in cross-section, a first side of the triangular shape being a base side of the triangular shape on the body portion of the respective snap fastener member or snaptop, an apex of the triangular shape being opposite the first side, a second side of the triangular shape forming an angle Y at the apex which is about 45° or less, and a third side of the triangular shape forming an angle X at the apex of about 45°; and wherein the second side of the triangular shape having the angle Y of the first fabric gripping protrusion faces the second side of the triangular shape having the angle Y of the second fabric gripping protrusion.

17. A water migration resistant snap fastener attachable to a fabric, comprising:

a stud having a socket engagement portion on a first side and a fabric contact side opposite the first side;

a plurality of first fabric gripping protrusions on the fabric contact side of the stud and arranged in a generally circular pattern about a center of the stud, the first fabric gripping protrusions being non-fabric-penetrating protrusions;

a first snaptop lockingly engagable to the stud with the fabric therebetween during use, the first snaptop having a fabric contact side;

a plurality of second fabric gripping protrusions on the fabric contact side of the first snaptop and arranged in a generally circular pattern about the center of the first snaptop, the second fabric gripping protrusions being radially offset from the first fabric gripping protrusions and being non-fabric-penetrating protrusions;

a socket having a stud engagement portion on a first side and a fabric contact side opposite the first side, the stud and the socket being releasably engagable with each other;

a plurality of third fabric gripping protrusions on the fabric contact side of the socket and arranged in a generally circular pattern about the center of the socket, the third fabric gripping protrusions being non-fabric-penetrating protrusions;

a second snaptop lockingly engagable to the socket with the fabric therebetween during use, the second snaptop having a fabric contact side; and a plurality of fourth fabric gripping protrusions on the fabric contact side of the second snaptop and arranged in a generally circular pattern about the center of the second snaptop, the fourth fabric gripping protrusions being radially offset from the third fabric gripping protrusions and being non-fabric-penetrating protrusions, wherein:

first portions of the fabric captured between the stud and first snaptop are squeezed by the first and second fabric gripping protrusions and are compressed relative to second portions of the fabric that are not squeezed by the first and second gripping protrusions, the second portions of the fabric being disposed between stud and the first snaptop, the first portions and the second portions of fabric are alternately spaced in a first radial pattern and a first axial pattern between the stud and the first snaptop, third portions of the fabric captured between the socket and the second snaptop are squeezed by the third and fourth gripping protrusions and are compressed relative to fourth portions of the fabric that are not squeezed by the third and fourth gripping protrusions, the fourth portions of the fabric being disposed between the socket and the second snaptop, and the third portions and the fourth portions of fabric are alternately spaced in a second radial pattern and a second axial pattern between the socket and the second snaptop.

* * * * *